US010047740B2

(12) United States Patent
Absmeier et al.

(10) Patent No.: US 10,047,740 B2
(45) Date of Patent: Aug. 14, 2018

(54) PUMP UNIT FOR A HIGH-PRESSURE PUMP

(75) Inventors: Michael Absmeier, Cham (DE); Xaver Gebhardt, Regensburg (DE); Anatoliy Lyubar, Regensburg (DE); Danica Stegemann, Nienburg/Weser (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 497 days.

(21) Appl. No.: 13/982,803

(22) PCT Filed: Jan. 30, 2012

(86) PCT No.: PCT/EP2012/051409
§ 371 (c)(1),
(2), (4) Date: Oct. 15, 2013

(87) PCT Pub. No.: WO2012/104236
PCT Pub. Date: Aug. 9, 2012

(65) Prior Publication Data

US 2014/0050597 A1 Feb. 20, 2014

(30) Foreign Application Priority Data

Jan. 31, 2011 (DE) ..... 10 2011 003 396

(51) Int. Cl.
*F04B 49/06* (2006.01)
*F04B 49/16* (2006.01)
(Continued)

(52) U.S. Cl.
CPC ..... *F04B 49/16* (2013.01); *F02M 55/04* (2013.01); *F02M 59/022* (2013.01);
(Continued)

(58) Field of Classification Search
CPC ..... F04B 1/0421; F04B 1/0404; F04B 9/042; F04B 49/16; F15B 1/021; F02M 57/023;
(Continued)

(56) References Cited

U.S. PATENT DOCUMENTS 1,154,798 A * 9/1915 Palmer ..... F04B 49/16
417/275
1,610,997 A * 12/1926 Cafferata ..... F02M 49/02
123/495
(Continued)

FOREIGN PATENT DOCUMENTS

CH 158033 A 10/1932 ..... F02M 59/02
CN 1886594 A 12/2006 ..... F02M 59/06
(Continued)

OTHER PUBLICATIONS

Chinese Office Action, Application No. 201280016478.2, 13 pages, dated Apr. 3, 2015.
(Continued)

*Primary Examiner* — Devon Kramer
*Assistant Examiner* — Joseph Herrmann
(74) *Attorney, Agent, or Firm* — Slayden Grubert Beard PLLC

(57) ABSTRACT

A pump unit includes a pump housing having a low-pressure inlet and a high-pressure outlet. A working medium is fed via the low-pressure inlet to a working chamber formed in the pump housing. The working medium is discharged from the working chamber via the high-pressure outlet. The pump unit also includes a pump piston channel formed in the pump housing and having a longitudinal axis. The pump unit has a first pump piston arranged movably along the longitudinal axis in the pump piston channel and coupled hydraulically to the working chamber. The pump unit also has a second pump piston arranged movably along the longitudinal axis in the pump piston channel and coupled hydraulically via a compensation volume to the first pump piston, wherein the compensation volume is coupled hydraulically to a compensation unit configured to adapt the compensation volume based on a pressure in the working chamber.

6 Claims, 7 Drawing Sheets

(51) Int. Cl.

| | |
|---|---|
| ***F04B 1/04*** | (2006.01) |
| ***F02M 59/02*** | (2006.01) |
| ***F02M 59/10*** | (2006.01) |
| ***F02M 59/20*** | (2006.01) |
| ***F02M 59/22*** | (2006.01) |
| ***F02M 59/44*** | (2006.01) |
| ***F02M 63/02*** | (2006.01) |
| ***F04B 9/06*** | (2006.01) |
| ***F04B 1/00*** | (2006.01) |
| ***F02M 55/04*** | (2006.01) |

(52) U.S. Cl.

CPC ..... *F02M 59/102* (2013.01); *F02M 59/20* (2013.01); *F02M 59/22* (2013.01); *F02M 59/447* (2013.01); *F02M 63/023* (2013.01); *F02M 63/0265* (2013.01); *F04B 1/00* (2013.01); *F04B 1/0404* (2013.01); *F04B 9/06* (2013.01); *F02M 2200/315* (2013.01)

(58) Field of Classification Search

CPC ..... F02M 57/024; F02M 41/126; F02M 41/1411; F02M 59/30; F02M 21/0245; F02M 37/04; F02M 69/02; F02D 2200/0602

USPC ..... 417/274, 540, 470, 275; 123/495, 503, 123/504, 508

See application file for complete search history.

(56) References Cited

U.S. PATENT DOCUMENTS

| | | | | | |
|---|---|---|---|---|---|
| 1,968,961 | A * | 8/1934 | Schaeren | F02M 59/022 | 417/498 |
| 2,011,165 | A * | 8/1935 | Steiner | F02M 59/02 | 417/498 |
| 2,011,166 | A * | 8/1935 | Steiner | F02M 59/022 | 267/34 |
| 2,019,650 | A * | 11/1935 | Bischof | F02M 59/18 | 123/447 |
| 2,071,237 | A * | 2/1937 | Rupprecht | F02M 57/02 | 239/90 |
| 2,720,842 | A * | 10/1955 | Downing | F02M 59/02 | 417/471 |
| 3,003,421 | A * | 10/1961 | Bessiere | F02M 59/32 | 417/206 |
| 3,847,507 | A * | 11/1974 | Sakiyama | B01L 3/0206 | 417/22 |
| 4,394,962 | A | 7/1983 | Wilber | 239/88 | |
| 4,449,504 | A | 5/1984 | Furuhashi et al. | 123/447 | |
| 4,881,504 | A | 11/1989 | Best | 123/447 | |
| 5,107,890 | A * | 4/1992 | Gute | F16K 15/044 | 137/539 |
| 5,291,867 | A | 3/1994 | Hummel et al. | 123/372 | |
| 5,785,505 | A * | 7/1998 | Price | F01M 1/02 | 123/71 R |
| 6,116,870 | A * | 9/2000 | Kraemer | F02M 59/464 | 417/490 |
| 6,253,734 | B1 * | 7/2001 | Rembold | F02D 41/3845 | 123/446 |
| 7,308,849 | B2 | 12/2007 | Schoetz et al. | 92/129 | |
| 7,775,193 | B2 | 8/2010 | Merz et al. | 123/495 | |
| 2007/0189911 | A1 * | 8/2007 | Holt | F04B 49/16 | 417/543 |

FOREIGN PATENT DOCUMENTS

| | | | | |
|---|---|---|---|---|
| CN | 1906411 | A | 1/2007 | F04B 1/04 |
| DE | 3205953 | C2 | 12/1985 | F02M 51/00 |
| DE | 3912106 | A1 | 11/1989 | F02M 57/02 |
| EP | 0320462 | B1 | 9/1991 | F02M 59/02 |
| EP | 1076173 | A2 | 2/2001 | F02D 1/02 |
| EP | 1403509 | A2 * | 3/2004 | F02M 55/04 |
| GB | 369541 | A | 3/1932 | F02M 59/22 |
| JP | 2001-123913 | A | 5/2001 | F02M 37/08 |

OTHER PUBLICATIONS

European Search Report, Application No. 16157404.1, 7 pages, dated Jul. 25, 2016.

European Search Report, Application No. 16157410.8, 6 pages, dated Jul. 25, 2016.

European Search Report, Application No. 16157416.5, 5 pages, dated Jul. 25, 2016.

International Search Report and Written Opinion, Application No. PCT/EP2012/051409, 12 pages, dated Sep. 19, 2012.

* cited by examiner

PUMP UNIT FOR A HIGH-PRESSURE PUMP

CROSS-REFERENCE TO RELATED APPLICATIONS

This application is a U.S. National Stage Application of International Application No. PCT/EP2012/051409 filed Jan. 30, 2012, which designates the United States of America, and claims priority to DE Application No. 10 2011 003 396.3 filed Jan. 31, 2011, the contents of which are hereby incorporated by reference in their entirety.

TECHNICAL FIELD

The invention relates to a pump unit for a high-pressure pump.

BACKGROUND

High-pressure pumps are regularly used for delivering fluid for an accumulator injection system for internal combustion engines of motor vehicles. Accumulator injection systems for internal combustion engines of motor vehicles, for example in common-rail systems, are intended to be able to provide the necessary volumetric flow and the required fluid pressure. The high-pressure pump is intended to adapt a quantity of combustion fuel that is to be delivered to the consumption of the internal combustion engine at a corresponding load working point.

SUMMARY

One embodiment provides a pump unit for a high-pressure pump, comprising: a pump housing which has a low-pressure inlet via which a working medium is fed to a working chamber which is formed in the pump housing, and a high-pressure outlet via which the working medium is discharged from the working chamber, a pump piston channel which is formed in the pump housing and has a longitudinal axis, a first pump piston which is arranged movably along the longitudinal axis in the pump piston channel and which is coupled hydraulically to the working chamber, and a second pump piston which is arranged movably along the longitudinal axis in the pump piston channel and is coupled hydraulically via a compensation volume to the first pump piston, wherein the compensation volume is coupled hydraulically to a compensation unit which is configured to adapt the compensation volume in a manner which is dependent on a pressure in the working chamber.

In a further embodiment, the compensation unit is configured to allow the compensation volume to be essentially unchanged during a delivery stroke of the second pump piston until a specified pressure is reached in the working chamber and to adapt the compensation volume with the effect of keeping the pressure in the working chamber constant over the course of a continuation of the delivery stroke.

Another embodiment provides a pump unit for a high-pressure pump, comprising: a pump housing with a low-pressure inlet via which a working medium is fed to a working chamber which is formed in the pump housing, and a high-pressure outlet via which the working medium is discharged from the working chamber, a pump piston channel which is formed in the pump housing and has a longitudinal axis, a first pump piston which is arranged movably along the longitudinal axis in the pump piston channel and which is coupled hydraulically to the working chamber, and a second pump piston which is arranged movably along the longitudinal axis in the pump piston channel and is coupled via a spring element to the first pump piston, wherein the spring element is configured to adapt a distance between the first pump piston and the second pump piston in a manner which is dependent on a pressure in the working chamber, wherein the spring element is configured to allow the distance between the first pump piston and the second pump piston to be essentially unchanged during a delivery stroke of the second pump piston until a specified pressure is reached in the working chamber and to adapt the distance with the effect of keeping the pressure in the working chamber constant over the course of a continuation of the delivery stroke.

In a further embodiment, the pressure in the working chamber is limited to a value of at maximum about 250 bar by means of the second pump piston.

Another embodiment provides a pump unit for a high-pressure pump, comprising: a pump housing which has a low-pressure inlet via which a working medium is fed to a working chamber which is formed in the pump housing, and a high-pressure outlet via which the working medium is discharged from the working chamber, a pump piston channel which is formed in the pump housing and has a longitudinal axis, a pump piston which is arranged movably along the longitudinal axis in the pump piston channel and which is coupled hydraulically directly to the working chamber, a compensation piston which is coupled hydraulically directly to the working chamber and which is arranged movably in a compensation piston channel having a second axis, wherein the compensation piston channel is arranged along the longitudinal axis opposite the pump piston channel, and a spring element which is coupled mechanically to the compensation piston at an end thereof which faces away from the working chamber, and is configured to influence a position of the compensation piston in a manner which is dependent on a force which acts on the spring element.

In a further embodiment, the compensation piston comprises an inlet valve.

Another embodiment provides a pump unit for a high-pressure pump, comprising: a pump housing which has a low-pressure inlet via which a working medium is fed to a working chamber which is formed in the pump housing, and a high-pressure outlet via which the working medium is discharged from the working chamber, a pump piston channel which is formed in the pump housing and has a longitudinal axis, a pump piston which is arranged movably along the longitudinal axis in the pump piston channel and is coupled hydraulically directly to the working chamber, a compensation piston which is coupled hydraulically directly to the working chamber and which is arranged movably in a compensation piston channel having a further axis, and a spring element which is coupled mechanically to the compensation piston at an end thereof which faces away from the working chamber, and is configured to influence a position of the compensation piston in a manner which is dependent on a pressure which acts on the spring element, wherein the compensation piston comprises an inlet valve.

In a further embodiment, a pressure in the working chamber is limited to a value of at maximum about 250 bar by means of the compensation piston.

In a further embodiment, the spring element has a spring characteristic with a decreasing profile.

In a further embodiment, the spring element has a specified pretension.

BRIEF DESCRIPTION OF THE DRAWINGS

Example embodiments of the present invention are discussed in detail below with reference to the drawings, in which.

DETAILED DESCRIPTION

Figure 1:
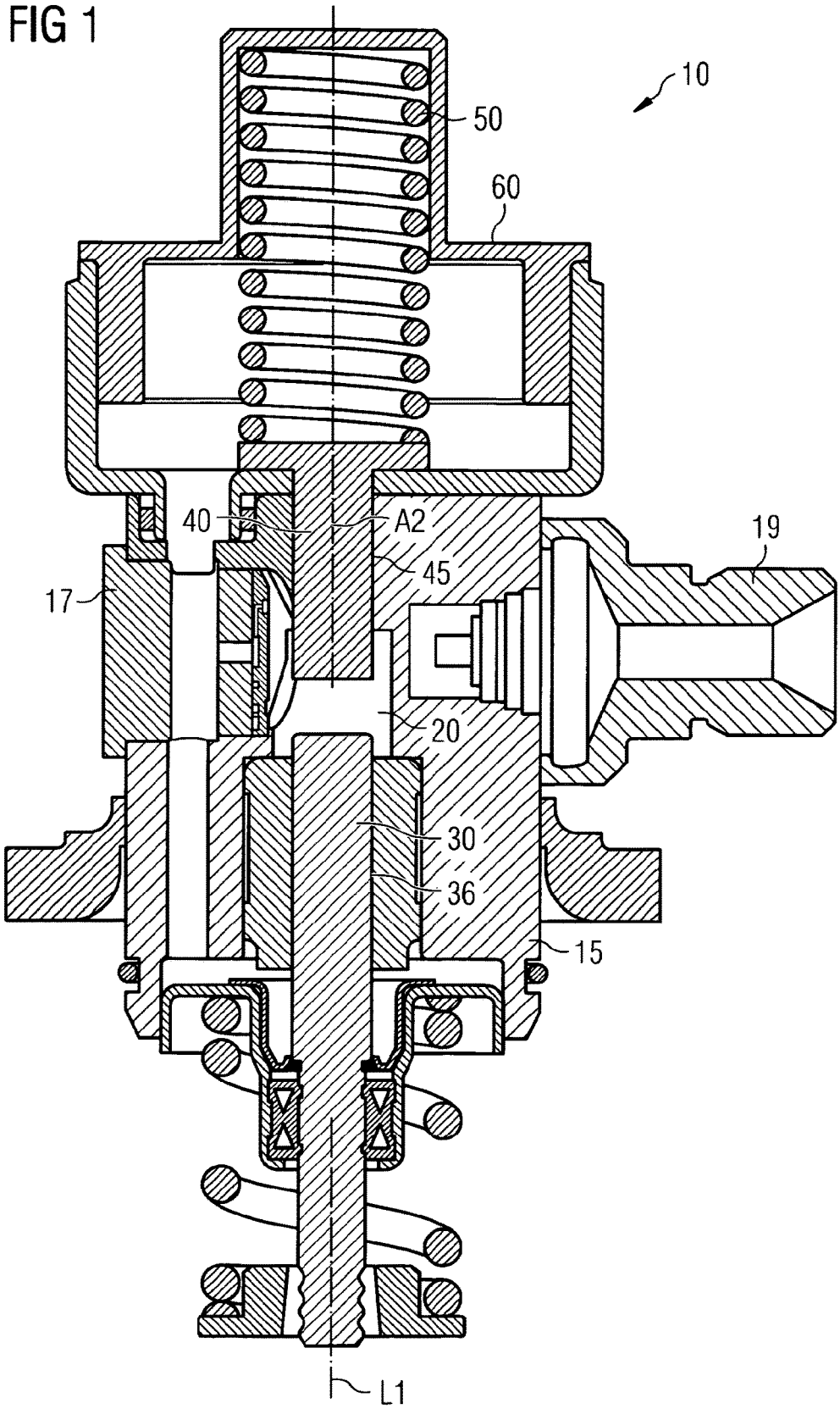
FIG. 1 shows a schematic view of a first exemplary embodiment of a pump unit.

Embodiments of the present disclosure provide a pump unit for a high-pressure pump, which makes it possible to adapt a quantity of a working medium which is to be delivered to specified requirements. In addition, the pump unit is intended to be able to be produced cost-effectively and have good energy efficiency.

One embodiment provides a pump unit for a high-pressure pump. The pump unit comprises a pump housing having a low-pressure inlet and a high-pressure outlet. A working medium is fed via the low-pressure inlet to a working chamber which is formed in the pump housing. The working medium is discharged from the working chamber via the high-pressure outlet. Furthermore, the pump unit comprises a pump piston channel which is formed in the pump housing and has a longitudinal axis. The pump unit has a first pump piston which is arranged movably along the longitudinal axis in the pump piston channel and is coupled hydraulically to the working chamber. Furthermore, the pump unit has a second pump piston which is arranged movably along the longitudinal axis in the pump piston channel and is coupled hydraulically via a compensation volume to the first pump piston, wherein the compensation volume is coupled hydraulically to a compensation unit which is configured to adapt the compensation volume in a manner which is dependent on a pressure in the working chamber.

This advantageously permits regulation of the volumetric flow of the working medium, preferably of a fuel, with a reduced number of components, and can contribute to the pump unit, and therefore the high-pressure pump, being able to have good energy efficiency. The saving on components permits cost-effective production. A separate electromagnetic volumetric flow regulating valve is not required between a fuel tank and the pump unit and/or an adaptation is not required of the volumetric flow to, for example, a current combustion fuel consumption of the internal combustion engine by throttling an inlet flow and/or by gradually shutting off a compressed quantity of fuel which is not required. For example, by gradually shutting off the quantity of fuel which is not required using a pressure-limiting valve, the energy efficiency can be noticeably worsened.

In one embodiment, the compensation unit is configured to allow the compensation volume to be essentially unchanged during a delivery stroke of the second pump piston until a specified pressure is reached in the working chamber and to adapt the compensation volume with the effect of keeping the pressure in the working chamber constant both over the course of a continuation of the delivery stroke. The compensation unit has the effect that, during a delivery stroke of the second pump piston, when the desired pressure is reached in the working chamber, the first pump piston essentially comes to a standstill and therefore a further quantity of the working medium is not delivered into the working chamber. Until the desired pressure is reached in the working chamber, the first pump piston and the second pump piston form a unit which essentially operates in the same manner as a single-part pump piston known from the prior art.

Another embodiment provides a pump unit for a high-pressure pump. The pump unit comprises a pump housing having a low-pressure inlet and a high-pressure outlet. A working medium is fed via the low-pressure inlet to a working chamber which is formed in the pump housing. The working medium is discharged from the working chamber via the high-pressure outlet. Furthermore, the pump unit comprises a pump piston channel which is formed in the pump housing and has a longitudinal axis. The pump unit has a first pump piston which is arranged movably along the longitudinal axis in the pump piston channel and which is coupled hydraulically to the working chamber. Furthermore, the pump unit has a second pump piston which is arranged movably along the longitudinal axis in the pump piston channel and which is coupled via a spring element to the first pump piston, wherein the spring element is configured to adapt a distance between the first pump piston and the second pump piston in a manner which is dependent on a pressure in the working chamber. The spring element is configured to allow the distance between the first pump piston and the second pump piston to be essentially unchanged during a delivery stroke of the second pump piston until a specified pressure is reached in the working chamber and to adapt the distance with the effect of keeping the pressure in the working chamber constant over the course of a continuation of the delivery stroke.

The spring element advantageously has the effect that, during the delivery stroke of the second pump piston, when the desired pressure is reached in the working chamber, the first pump piston essentially comes to a standstill and therefore no further quantity of the working medium is delivered to the working chamber. Until the desired pressure is reached in the working chamber, the first pump piston and the second pump piston form a unit which essentially operates in the same manner as a single-part pump piston known from the prior art.

In a further embodiment, the pressure in the working chamber is limited to a value of a maximum about 250 bar by means of the second pump piston.

Another embodiment provides a pump unit for a high-pressure pump. The pump unit comprises a pump housing have a low-pressure pressure inlet and a high-pressure outlet. A working medium is fed via the low-pressure inlet to a working chamber which is formed in the pump housing. The working medium is discharged from the working chamber via the high-pressure outlet. The pump unit comprises a pump piston channel which is formed in the pump housing and has a longitudinal axis. Furthermore, the pump unit has a pump piston which is arranged movably along the longitudinal axis in the pump piston channel and which is coupled hydraulically directly to the working chamber. The pump unit comprises a compensation piston which is coupled hydraulically directly to the working chamber and which is arranged movably along a second axis, which is the longitudinal axis, in a compensation piston channel, wherein the compensation piston channel is arranged along the longitudinal axis opposite the pump piston channel. Furthermore, the pump unit has a spring element which is coupled mechanically to the compensation piston at an end thereof which faces away from the working chamber, and which is configured to influence a position of the compensation piston in a manner which is dependent on a force which acts on the spring element. This permits a highly flexible solution, since the spring element can be arranged in further components of the high-pressure pump, for example in a pressure compensation vessel of the high-pressure pump, instead of in the pump housing. It is also possible, for example, for the spring element and the compensation piston channel to be arranged combined with the low-pressure inlet and/or high-pressure outlet. This has the advantage that, for example, already existing high-pressure pumps and/or high-pressure pump concepts can be retrospectively equipped with such a compensation device, for example by interchanging a low-pressure inlet assembly. The spring element advantageously has the effect that, during the delivery stroke of the pump piston, when the desired pressure is reached in the working chamber, the compensation piston is moved out of the working chamber, and thus, upon continuation of the course of the delivery stroke of the pump piston, the volume of the working chamber remains substantially constant.

In one embodiment, the compensation piston comprises an inlet valve.

Another embodiment provides a pump unit for a high-pressure pump. The pump unit comprises a pump housing having a low-pressure inlet and a high-pressure outlet. A working medium is fed via the low-pressure inlet to a working chamber which is formed in the pump housing. The working medium is discharged from the working chamber via the high-pressure outlet. The pump unit comprises a pump piston channel which is formed in the pump housing and has a longitudinal axis. Furthermore, the pump unit has a pump piston which is arranged movably along the longitudinal axis in the pump piston channel and which is coupled hydraulically directly to the working chamber. The pump unit comprises a compensation piston which is coupled hydraulically directly to the working chamber and which is arranged movably along a further axis in a compensation piston channel. Furthermore, the pump unit has a spring element which is coupled mechanically to the compensation piston at an end thereof which faces away from the working chamber, and which is configured to influence a position of the compensation piston in a manner which is dependent on a force which acts on the spring element. The compensation piston comprises an inlet valve.

In one embodiment, a pressure in the working chamber is limited to a value of at maximum about 250 bar by means of the compensation piston.

In one embodiment, the spring element has a spring characteristic with a decreasing profile. For example, the spring element can have a disk spring.

In one embodiment, the spring element has a specified pretension.

Exemplary embodiments are explained below with reference to the schematic drawings.

Figure 6:
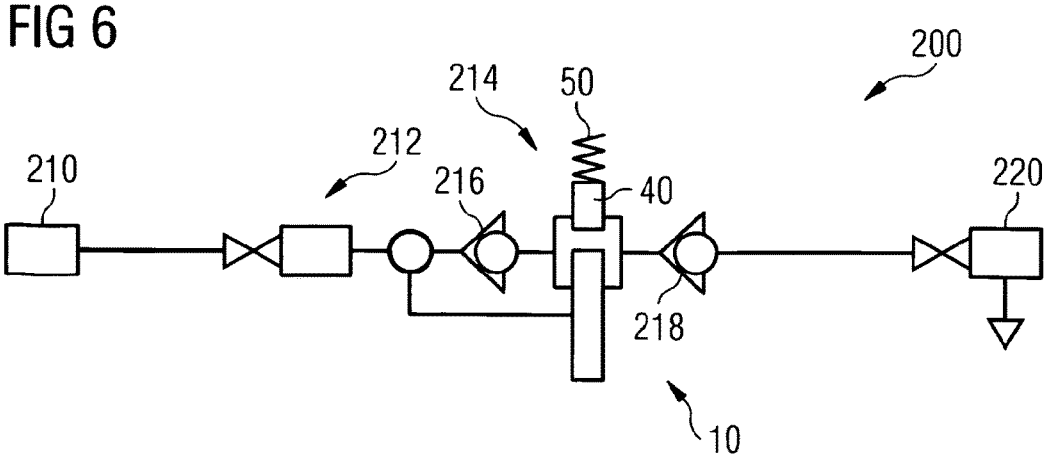
FIG. 6 shows a schematic view of an accumulator injection system with the pump unit.

FIG. 6 shows a hydraulic scheme of an accumulator injection system 200 for internal combustion engines. The accumulator injection system 200 has a predelivery pump 210 for delivering fuel from a fuel tank (not illustrated). A filtering and damping unit 212 is arranged downstream of the predelivery pump 210. Furthermore, a high-pressure pump 214 with at least one pump unit 10 is arranged downstream of the predelivery pump 210 and of the filtering and damping unit 212. The pump unit 10 has an inlet valve 216 and an outlet valve 218. The inlet valve 216 may be configured as a digital inlet valve, by means of which the volumetric flow at the inlet of the pump unit 10 is regulated. By means of the high-pressure pump 214, the fuel is delivered into a fuel accumulator 220 in order to pass from there to injection valves (not illustrated).

FIG. 1 shows a first exemplary embodiment of the pump unit 10 of the high-pressure pump 214. The high-pressure pump 214 can be configured, for example, as a radial piston pump. For example, the high-pressure pump 214 can be provided for supplying fuel in a high-pressure accumulator injection system, such as, for example, in a common-rail injection system.

The pump unit 10 comprises a pump housing 15 having a low-pressure inlet 17 and a high-pressure outlet 19. In order to be able to fill a working chamber 20, which is arranged in the pump housing 15, with a working medium, in particular a fluid, the low-pressure inlet 17 has, for example, a supply line which may be coupled hydraulically to the working chamber 20 by means of an inlet valve. The inlet valve serves to prevent flowback into the admission line, in particular during filling and compression of the working medium.

The high-pressure outlet 19 has a discharge line and an outlet valve which may be arranged therein. The outlet valve is configured, for example, as a high-pressure valve which permits the working medium to be ejected from the working chamber 20 into the discharge line only above a specified fluid pressure in the working chamber 20. The outlet valve prevents the working medium from flowing back, for example out of a rail, into the pump unit 10.

The pump unit 10 furthermore comprises a pump piston 30 which is arranged in a pump piston channel 36 which is formed in the pump housing 15. The pump piston channel 36 has a longitudinal axis L1 along which the pump piston 30 is arranged movably. The pump piston 30 is coupled hydraulically directly to the working chamber 20.

During a suction stroke, i.e. during a movement of the pump piston 30 in a direction away from the working chamber 20, the working medium, for example the fuel, is delivered from the admission line via the inlet valve into the working chamber 20, with the outlet valve being closed. During a delivery stroke, that is to say, during a movement of the pump piston 30 in a direction toward the working chamber 20, the working medium in the working chamber 20 is compressed or is dispensed to the discharge line under high pressure via the outlet valve, with the inlet valve being closed.

In the exemplary embodiment of the pump unit 10 that is shown in FIG. 1, the pump unit 10 has a compensation piston 40. The compensation piston 40 is arranged in a compensation piston channel 45. The compensation channel has a second axis A2 along which the compensation piston 40 is arranged movably in the compensation channel. The compensation piston 40 is likewise coupled hydraulically directly to the working chamber 20. Furthermore, the pump unit 10 comprises a spring element 50. The spring element 50 is coupled mechanically to the compensation piston 40 at a first end thereof that faces away from the working chamber 20. The spring element 50 is configured to influence a position of the compensation piston in a manner which is dependent on a force acting on the spring element 50. The spring element 50 here can have, for example, a decreasing spring characteristic.

Figure 7:
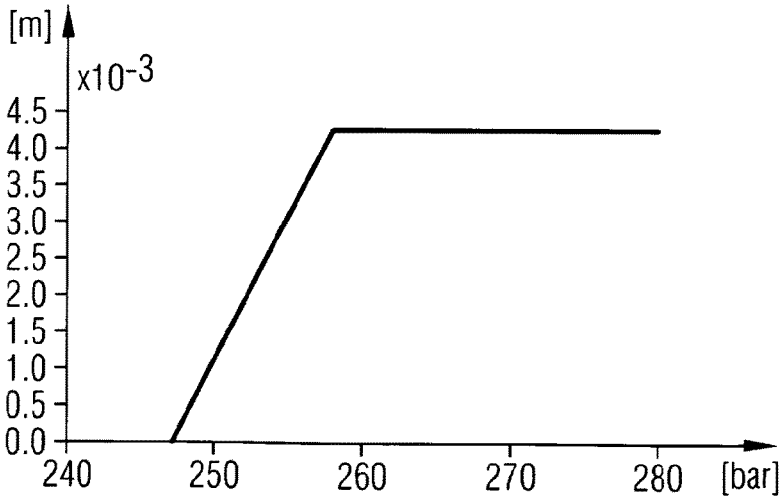
FIG. 7 shows a schematic view of the functional dependency of the stroke of a compensation piston of the pump unit on a pressure of the pump unit.

An advantageous configuration of the compensation piston 40 and of the spring element 50 in the case of a pump piston 30 having a diameter of 10 mm and a stroke of 2 mm is:

diameter of the compensation piston 40: 10 mm
maximum stroke of the compensation piston 40: 4.2 mm
mass of the compensation piston 40: 8 g
spring element 50: spring constant 20.3 N/mm, pretension 1900 N The compensation piston 40 begins a movement only when the pressure in the working chamber 20 exceeds a specified value. Said specified pressure in the working chamber 20 may be about 245 bar. The compensation piston 40 ends its movement as soon as the pressure in the working chamber 20 exceeds a further specified value. Said further specified pressure in the working chamber 20 may be about 258 bar. The effect which can be achieved therewith is that, at a pressure in the working chamber 20 of about 245 bar, the compensation piston 40 compensates for the change in volume in the working chamber 20 by means of the pump piston 30, and therefore a further pressure increase in the working chamber 20 can be avoided. The pressure in the working chamber 20 can therefore be limited to a value of about 245 bar by means of the compensation piston 40. This is shown in particular in FIG. 7 with a schematic view of the functional dependency of the stroke of the compensation piston 40 of the pump unit 10 of the pressure in the working chamber 20.

Figure 8A:
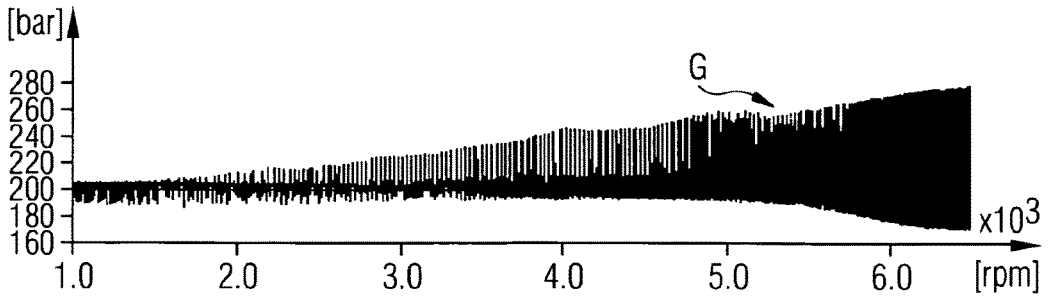
FIGS. 8*a*, 8*b* and 8*c* show illustrations of the pressure and of the injection quantity of the pump unit in dependence on a rotational speed of the pump unit.
Figure 8B:
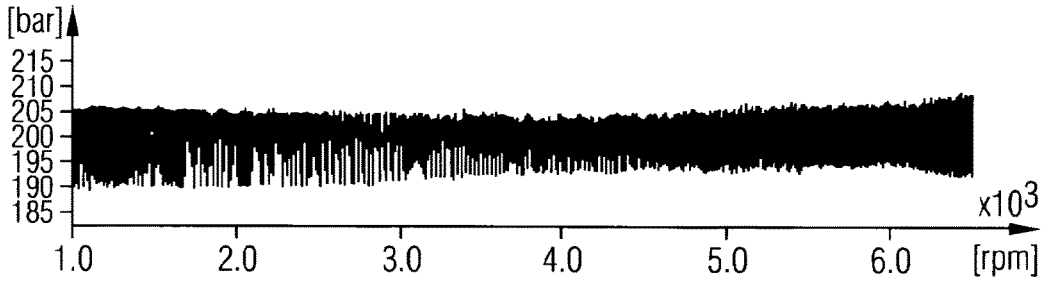
Figure 8C:
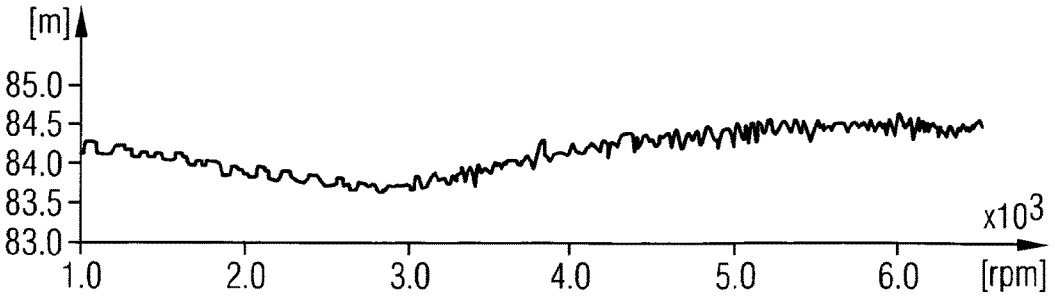

Furthermore, FIGS. 8*a*, 8*b* and 8*c* illustrate the pressure profiles at the outlet of the pump unit 10 (FIG. 8*a*) and in the fuel accumulator 220 (FIG. 8*b*) and also injector injection quantities in dependence on a rotational speed of the pump unit 10 (FIG. 8*c*). It is thus shown in particular in FIG. 8*a* that the pressure at the outlet of the pump unit 10 can be limited to a value of about 245 bar by means of the compensation piston 40, in particular at higher rotational speeds (here above about 4800) (see boundary G between the dark and the lighter region).

The compensation piston 40 can be arranged in the pump housing 15, for example in such a manner that the longitudinal axis L1 of the pump piston channel 36 and the second axis A2 enclose a specified angle. In particular, the compensation piston channel 45 can likewise be arranged along the longitudinal axis L1 opposite the pump piston channel 36.

The spring element 50 can be arranged, for example, in a further vessel 60 of the pump unit 10. The spring element 50 can be arranged in the vessel 60 in such a manner that the spring element 50 has a pretension.

Figure 2:
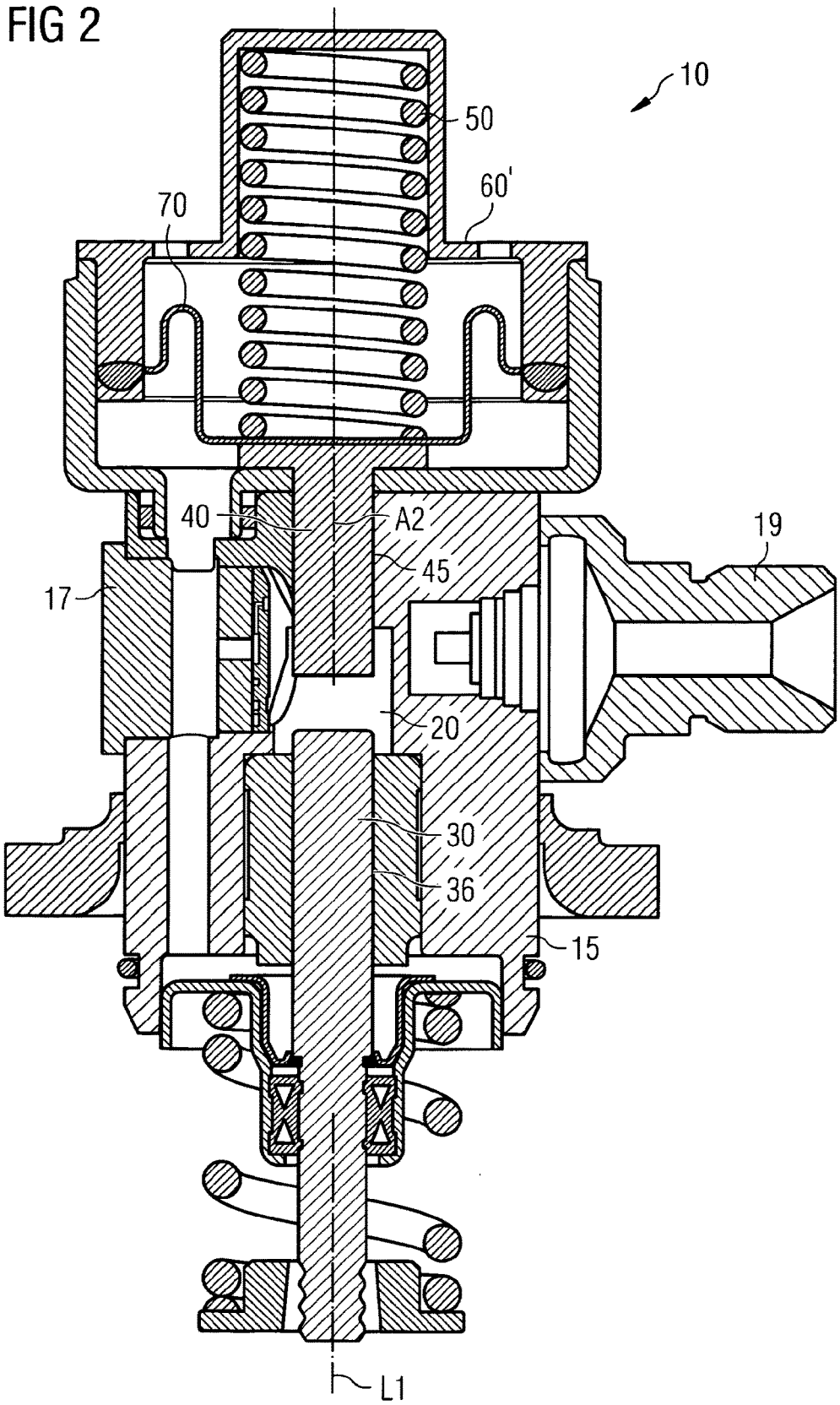
FIG. 2 shows a schematic view of a second exemplary embodiment of the pump unit.

FIG. 2 shows a second exemplary embodiment of the pump unit 10, in which the spring element 50 is arranged in a pressure compensation vessel 60'. The spring element 50 in this case can additionally be used to damp pressure pulsations. For this purpose, in the exemplary embodiment shown in FIG. 2, a movable element 70, for example a rolling diaphragm, is mounted between the compensation piston 40 and the spring element 50.

Figure 3:
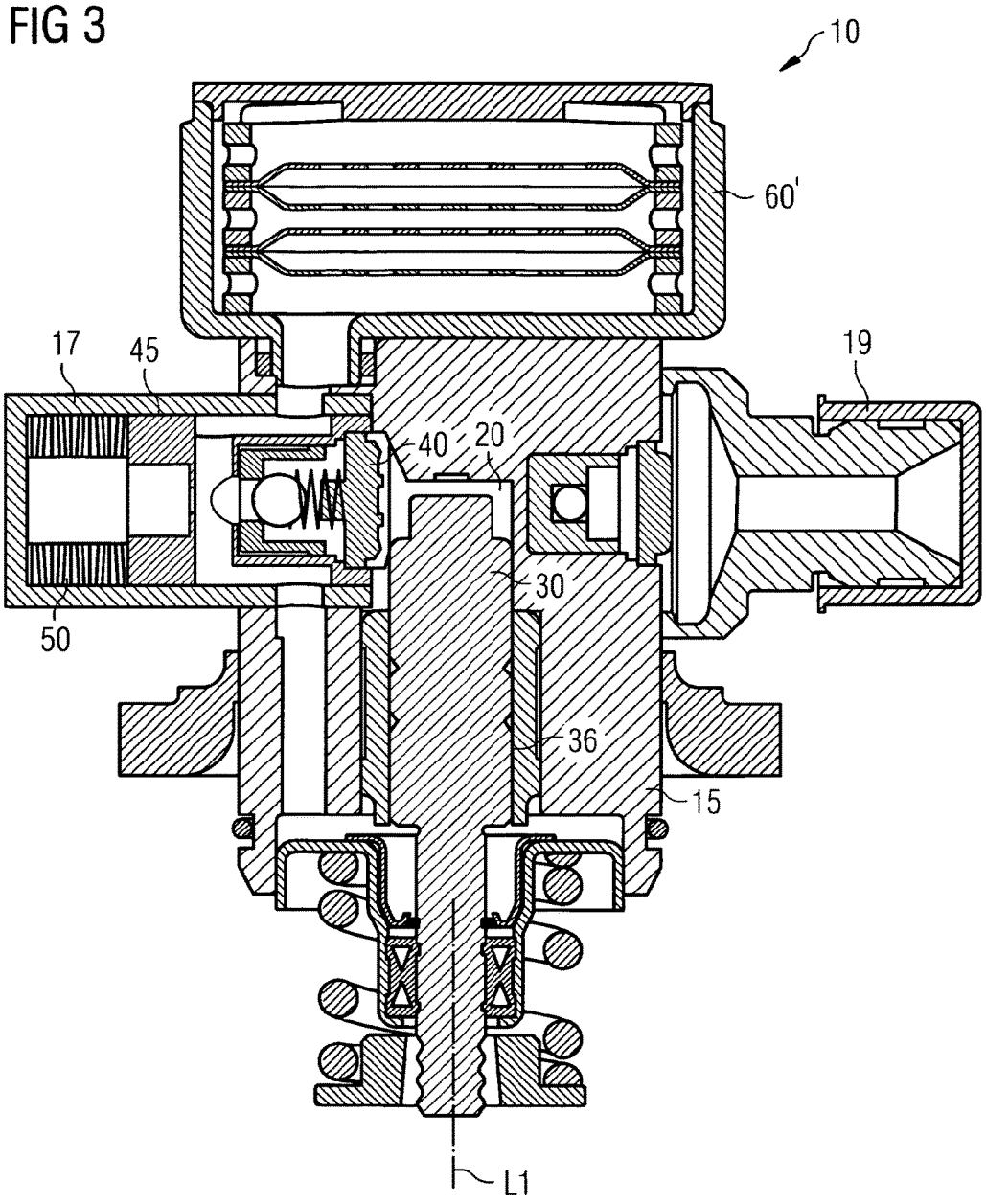
FIG. 3 shows a schematic view of a third exemplary embodiment of the pump unit.

FIG. 3 shows a third exemplary embodiment of the pump unit 10 in which the pump unit 10 has a combined arrangement of the compensation piston 40 and the inlet valve. For example, the compensation piston 40 can comprise the inlet valve.

Figure 4:
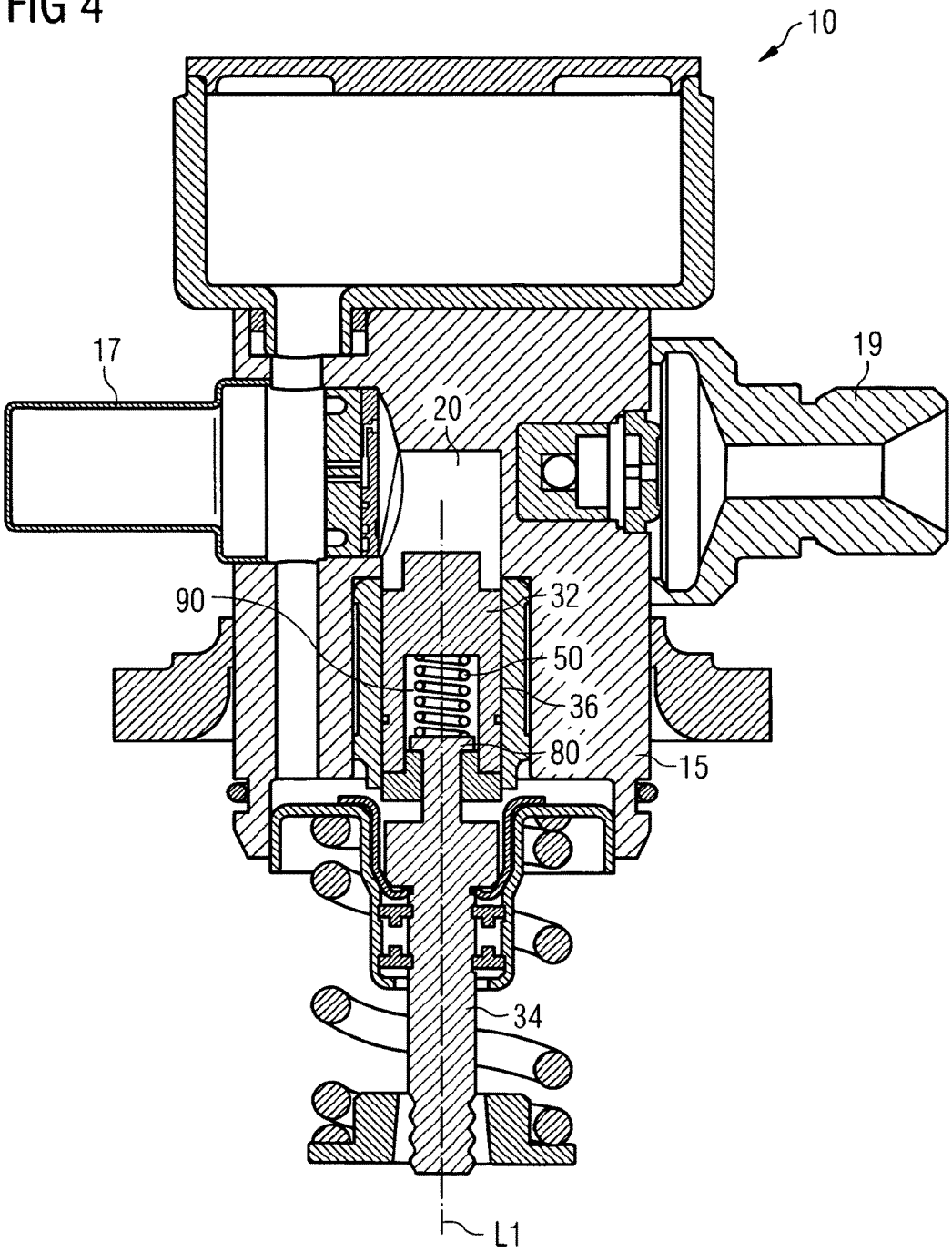
FIG. 4 shows a schematic view of a fourth exemplary embodiment of the pump unit.

FIG. 4 shows a fourth exemplary embodiment of the pump unit 10. In contrast to the exemplary embodiment shown in FIG. 1, the pump unit 10 has a first pump piston 32 and a second pump piston 34. The first pump piston 32 is arranged movably along the longitudinal axis L1 in the pump piston channel 36 and is coupled hydraulically directly to the working chamber 20. The second pump piston 34 is likewise arranged movably along the longitudinal axis L1 in the pump piston channel 36 and is coupled to the first pump piston 32 via the spring element 50, wherein the spring element 50 is configured to adapt a distance between the first pump piston 32 and the second pump piston 34 in a manner which is dependent on a pressure in the working chamber 20. The spring element 50 is configured to allow the distance between the first pump piston 32 and the second pump piston 34 to be essentially unchanged during a delivery stroke of the second pump piston 34 until a specified pressure is reached in the working chamber 20 and to adapt the distance with the effect of keeping the pressure in the working chamber 20 constant over the course of a continuation of the delivery stroke of the second pump piston 34. The first pump piston 32 has a recess 90 at a first end facing the second pump piston 34. The spring element 50 is arranged in the recess 90. Alternatively, the spring element can be arranged outside the first pump piston. The second pump piston has a plunger 80 at a first end facing the first pump piston 32. The plunger 80 is coupled mechanically to the spring element 50.

Figure 5:
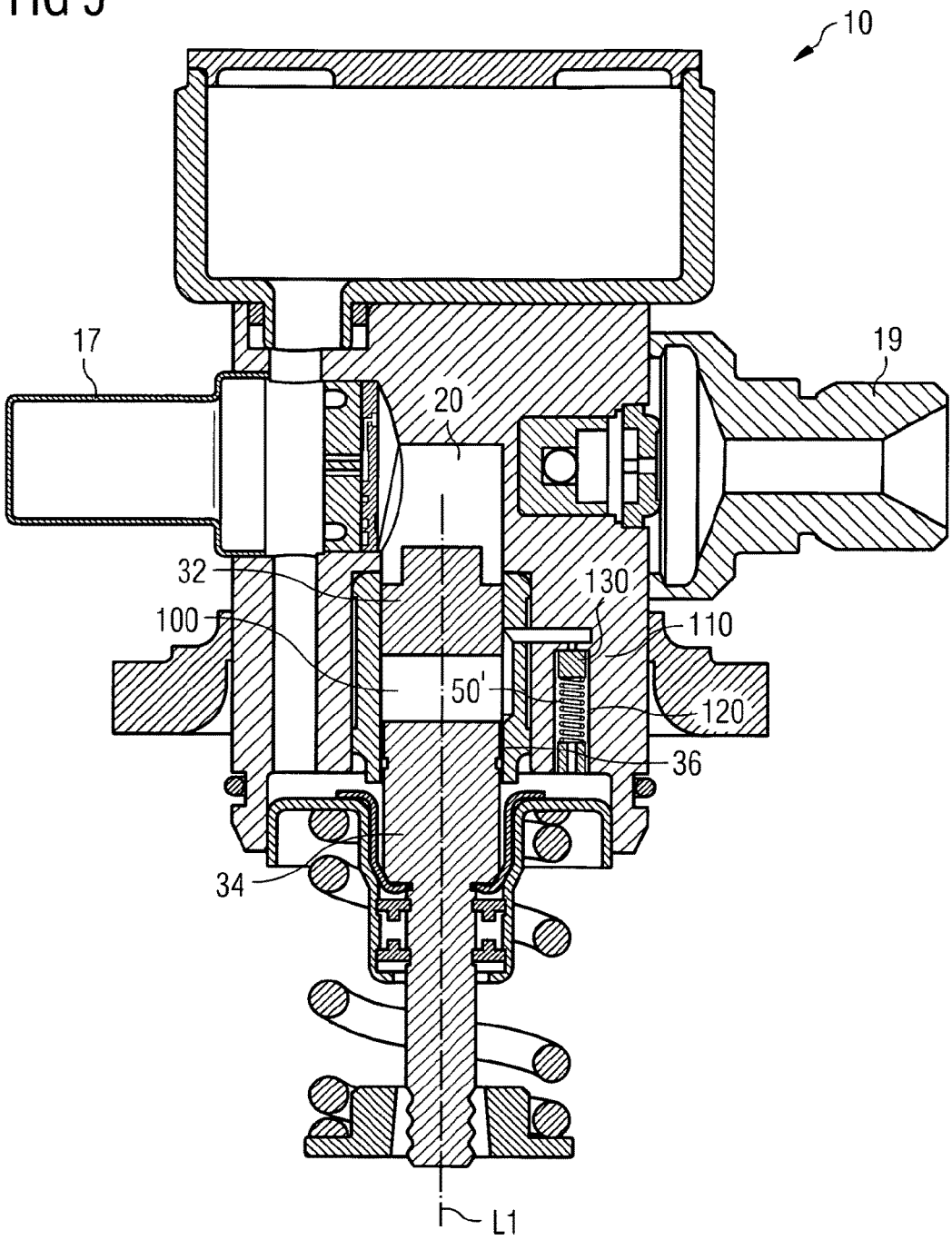
FIG. 5 shows a schematic view of a fifth exemplary embodiment of the pump unit.

FIG. 5 shows a fifth exemplary embodiment of the pump unit 10. In contrast to the exemplary embodiment shown in FIG. 4, the second pump piston 34 is coupled hydraulically via a compensation volume 100 to the first pump piston 32, wherein the compensation volume 100 is coupled hydraulically to a compensation unit 110 which is configured to adapt the compensation volume 100 in a manner which is dependent on a pressure in the working chamber 20. The compensation unit 110 is configured, for example, to allow the compensation volume 100 to be essentially unchanged during a delivery stroke of the pump piston until a specified pressure is reached in the working chamber 20 and to adapt the compensation volume 100 within the meaning of keeping the pressure in the working chamber 20 constant over the course of a continuation of the delivery stroke.

The compensation unit 110 comprises, for example, a compensation chamber 120 which is arranged in the pump housing 15. The compensation chamber preferably has an opening via which the compensation chamber is coupled hydraulically in a manner free from resistance to a pump inlet. Furthermore, the compensation unit 110 comprises a further spring element 50' which is arranged in the compensation chamber 120. The compensation unit 110 furthermore comprises a piston 130 which is arranged movably along a third axis in the compensation chamber 120. The piston is coupled mechanically at a first end to the further spring element 50' and, at a second end, is coupled hydraulically directly to the working volume. The further spring element 50' can have a spring characteristic with a decreasing profile. Furthermore, the further spring element 50' can be arranged and configured in such a manner that it has a specified pretension.

What is claimed is:

1. A pump unit for a high-pressure pump, comprising:

a pump housing having a low-pressure inlet via which a working medium is fed to a working chamber formed in the pump housing, and a high-pressure outlet via which the working medium is discharged from the working chamber, a pump piston channel formed in the pump housing and having a longitudinal axis, a first pump piston having a solid form with no internal passages or hollows and arranged movably along the longitudinal axis in the pump piston channel and coupled hydraulically to the working chamber, and a second pump piston arranged movably along the longitudinal axis in the pump piston channel and coupled hydraulically via the working chamber to the first pump piston, a spring element disposed in a compensation vessel and resisting movement by the second pump piston away from the first pump piston, wherein the second pump piston moves based on a pressure in the working chamber, and the second pump piston hydraulically separates the compensation vessel from the working chamber, wherein the working medium enters the compensation vessel via the low-pressure inlet, wherein a volume of the compensation vessel is unchanged during a delivery stroke of the first pump piston until a specific pressure is reached in the working chamber, and the second pump piston adapts the volume of the compensation vessel to keep the pressure in the working chamber constant over the course of a continuation of the delivery stroke.

2. The pump unit of claim 1, wherein the pressure in the working chamber is limited to a value of at maximum about 250 bar using the second pump piston.

3. The pump unit of claim 1, wherein the spring element preloads the second pump piston against movement into the compensation vessel.

4. The pump unit of claim 3, wherein the spring element has a specified pretension.

5. A pump unit for a high-pressure pump, comprising:

a pump housing having a low-pressure inlet via which a working medium is fed to a working chamber formed in the pump housing, and a high-pressure outlet via which the working medium is discharged from the working chamber, a pump piston channel formed in the pump housing, the pump piston channel having a longitudinal axis, a pump piston having a solid form with no internal passages or hollows and arranged movably along the longitudinal axis in the pump piston channel and coupled hydraulically directly to the working chamber, a compensation piston coupled hydraulically directly to the working chamber and arranged movably in a compensation piston channel having a second axis, wherein the compensation piston channel is arranged along the longitudinal axis opposite the pump piston channel, and a spring element coupled mechanically to the compensation piston at an end of the compensation piston that faces away from the working chamber, the spring element disposed in a compensation vessel, wherein the spring element is configured to influence a position of the compensation piston based on a force which acts on the spring element, wherein the compensation piston moves against the spring element to keep the pressure in the working chamber constant over the course of a continuation of the delivery stroke of the pump piston, and the compensation piston hydraulically separates the compensation vessel from the working chamber, wherein the working medium enters the compensation vessel via the low-pressure inlet.

6. The pump unit of claim 5, wherein the pressure in the working chamber is limited to a value of at maximum about 250 bar by the compensation piston.

* * * * *